US008550293B2

(12) United States Patent
Garson et al.

(10) Patent No.: US 8,550,293 B2
(45) Date of Patent: Oct. 8, 2013

(54) REPLACEMENT SHELF FOR A VENDING MACHINE

(75) Inventors: Brent D. Garson, Orange, OH (US); Barry P. May, Cleveland, OH (US); Roger J. May, Jr., Parma, OH (US)

(73) Assignee: Vendors Exchange International, Inc., Cleveland, OH (US)

( * ) Notice: Subject to any disclaimer, the term of this patent is extended or adjusted under 35 U.S.C. 154(b) by 742 days.

(21) Appl. No.: 12/584,047

(22) Filed: Aug. 28, 2009

(65) Prior Publication Data

US 2011/0049067 A1 Mar. 3, 2011

(51) Int. Cl.
*G07F 11/00* (2006.01)

(52) U.S. Cl.
USPC ..... 221/75; 211/59.3

(58) Field of Classification Search
USPC ..... 211/59.3, 183, 184; 221/75, 76, 242, 221/129, 123, 124, 261, 311; 312/138.1, 312/215, 321.5; 222/410
See application file for complete search history.

(56) References Cited

U.S. PATENT DOCUMENTS 3,335,907 A * 8/1967 Holstein et al. ..... 221/6
3,344,953 A * 10/1967 Merrill et al. ..... 221/75
3,591,045 A * 7/1971 Sturrock ..... 221/75
3,861,561 A * 1/1975 Wittern et al. ..... 221/75
3,989,163 A * 11/1976 Wittern ..... 221/75
3,993,215 A * 11/1976 Cox et al. ..... 221/75
4,061,245 A * 12/1977 Lotspeich ..... 221/75
4,506,802 A * 3/1985 Lotspeich ..... 221/75
5,341,954 A * 8/1994 Smith ..... 221/85

OTHER PUBLICATIONS

Manual, "Instruction Manual for Snackshop 113", Automatic Products International, Ltd., (Date Unknown), pp. i-51.

* cited by examiner

*Primary Examiner* — Korie H Chan

(74) *Attorney, Agent, or Firm* — Tarolli, Sundheim, Covell & Tummino LLP

(57) ABSTRACT

A replacement shelf for displaying, storing, and vending flat pack gum and candy replaces an existing shelf which was dedicated solely to vending old style five stick gum and roll candy. The replacement shelf includes a plurality of parallel product guides each of which includes a planar bottom surface and a pair of parallel spaced apart product support rails which cooperate to support product to be stored, displayed and vended in a position above the planar bottom surface of the product guides and in a position which ensures that the product is directed to fall downwardly from the product guide into a delivery bin in the vending machine.

4 Claims, 5 Drawing Sheets

REPLACEMENT SHELF FOR A VENDING MACHINE

BACKGROUND OF THE INVENTION

The present invention relates to a new and improved replacement shelf for replacing an existing typical five stick gum and roll candy shelf in a prior art vending machine.

Certain prior art vending machines include a plurality of shelves each of which includes a plurality of product guides for displaying, storing, and directing product to be vended to a delivery bin where the product is retrieved by a purchaser. In many of the prior art machines a dedicated shelf is provided for vending typical five stick gum packages and roll candy packages. These dedicated shelves for vending typical five stick gum packages and roll candy packages are not able to accommodate newer style gum and candy packages which are typically sold in flat or slim pack packages which accommodate more product and which have a different cross-sectional configuration than the old typical five stick gum packages. Five stick gum packages and some six stick gum packages generally measure slightly less than three inches by approximately three-quarters of inch by one-half inch. The product guides in the prior art shelf which are designed to accommodate these packages generally have a cross-sectional configuration of approximately three and one eighth inches wide by one inch high.

Newer style flat pack gum packages generally accommodate between 12 and 18 pieces of gum in a flat package. These new style packages cannot be accommodated in the old style five stick gum and roll candy shelf because the new style packages are much larger than the old five stick gum packages. Examples of the new style packaging include Dentyne and Trident sugarless gum 12 pieces blister pack packages manufactured by Cadbury Adams USA, LLC which measure approximately four inches by two and one-half inches by one-quarter inch, Stride, and Trident Extra Care sugarless gum 14 piece packages manufactured by Cadbury Adams USA, LLC which measures approximately three and one-half inches by two and one eighth inches by one-quarter inch, Extra Polar Ice sugarless gum 15 piece package manufactured by Wm. Wrigley Jr. Company which measures approximately three inches by two and one-half inches by one-half inch, Orbit sugarfree gum 14 piece packages manufactured by WM. Wrigley Jr. Company which measures approximately three and three-quarter inches by two inches by one-half inch, Cobalt sugarfree gum, Doublemint and Juicy Fruit gum 15 piece packages manufactured by Wm. Wrigley Jr. Company which measures approximately two inches by two and one half inch by one-half inch and Trident sugarless gum 18 piece package which measures three and one-quarter inches by one and one-half inches by one-half inch. Newer hard candy package such as Altoids mints 1.76 oz. Packages distributed by Callard & Bowser which measure approximately three and three-quarter inches by two and one-quarter inches by three-quarters inch and Ice Breaker sugarfree mints manufactured by the Hershey Company which are packaged in cylindrical packages approximately three inches in diameter and three-quarter inch high also will not fit in the old style prior art five stick gum and roll candy shelves.

Since the prior art five stick gum and roll candy shelves do not accommodate current flat and cylindrical packaging for gum, candy and other snacks, it is desirable to replace the five stick gum and roll candy shelves with a new shelf which will accommodate the new style "flat pack" gum, candy and snack packages such as those described in the previous paragraph. It is desirable that the new replacement shelf maximize the number of new style products which can be accommodated by maximizing the number of parallel product guides disposed in the replacement shelf. It is also desirable to provide a new product shelf which can easily replace an existing prior art five stick gum and roll candy shelf with minimum or no modification of the prior art vending machine.

SUMMARY OF THE INVENTION

The present invention provides a replacement shelf for a vending machine for storing, displaying and vending new style flat pack gum and candy packages which replaces an existing five stick gum and roll candy shelf in a prior art vending machine.

The present invention provides a replacement shelf for storing, displaying and vending flat pack gum and candy packages which replaces an existing five stick gum and roll candy shelf in a vending machine. The existing five stick gum and roll candy shelf includes a pair of parallel tracks which engage with a plurality of slides or supports in the vending machine to support the existing shelf in the vending machine. The replacement shelf also includes a pair of parallel tracks which are supported in at least some of the same supports in the vending machine after the existing five stick gum and roll candy shelf has been removed. The replacement shelf includes a plurality of parallel product guides for storing and displaying product and for directing selected product to be vended to a delivery bin in the vending machine where the product may be retrieved by a purchaser. Each of the product guides includes a planar bottom surface having a front edge and a motor assembly and helical coil having a longitudinal axis for in part supporting products to be vended in the product guide. The motor is operable to rotate the helical coil about the coils longitudinal axis to move products which are supported in the helical coil along the longitudinal axis of the helical coil through the product guide to the delivery bin. An elongate product support extends within each of the product guides in a direction parallel to the longitudinal axis of the helical coil and cooperates with the helical coil to support, in the product guide, product to be vended in a position above the planar bottom surface of the product guide. The product support extends beyond the front edge of the planar bottom surface of the product guide to a position above the delivery bin to ensure product to be vended from the product guide falls downwardly into the delivery bin.

The present invention further provides a replacement shelf for replacing an existing five stick gum and roll candy shelf in a vending machine as set forth in the previous paragraph wherein the elongate product support includes a pair of spaced apart product support members each of which include a product support surface for supporting in a position above the planar bottom surface of the product guide product to be stored, displayed, and vended in the product guide. The product support surface of each of the spaced apart product support members extends beyond the front edge of the planar bottom surface of the product guide to a position above the delivery bin of the vending machine to ensure that product to be vended from each of the product guides falls from the product support surface into the delivery bin.

BRIEF DESCRIPTION OF THE DRAWINGS

The foregoing and other features of the present invention will become apparent upon consideration of the following description taken in connection with the accompanying drawings wherein.

DESCRIPTION OF A SPECIFIC EMBODIMENT OF THE INVENTION

Figure 1:
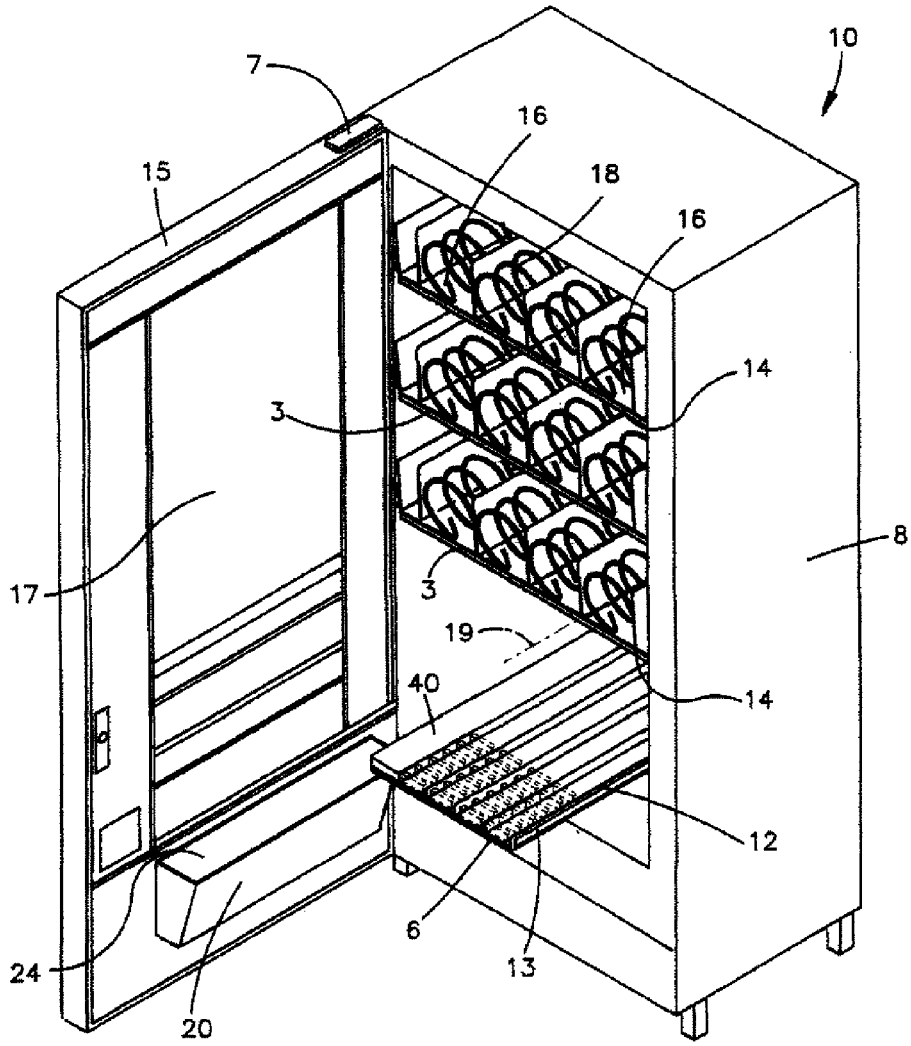
Fig.1 PRIOR ART
FIG. 1 is a perspective view of a prior art vending machine with the front door open and the prior art five stick gum and roll candy shelf partially removed from the vending machine.

The present invention provides a new and improved replacement shelf for replacing an existing five stick gum and roll candy shelf 12 in a prior art vending machine 10. The prior art vending machine 10 includes a housing 8 which supports therein a plurality of shelves 14 each of which include a plurality of parallel product guides 16. Each of the product guides 16 includes a helical coil 18 having a longitudinal axis 19. Each of the helical coils 18 is operable to be selectively rotated about its longitudinal axis 19 by a motor in a well known manner to move product supported in the helical coil 18 through the product guide 16 to the front edge 3 of the shelf 14 where the product is allowed to fall to a delivery bin 20 in a well known manner.

The vending machine 10 includes a door 15 which is pivotally mounted on hinges 7 to the housing 8. The door 15 can rotate from an open position, illustrated in FIG. 1, to a closed position, not illustrated. A transparent window 17 is located in the door 15 and the products to be vended and the product guides 16 are visible through the window 17 when the door 15 is closed.

The delivery bin 20 is mounted on the door 15 of the vending machine 10. When the door 15 is closed, the delivery bin 20 is in a position to receive product falling from the shelves 14 when a selected helical coil 18 is rotated by its associated motor. The delivery bin 20 includes an opening 24 at the top which is located beneath the front edge 3 of each of the shelves 14 to receive product from the product guides 16 in a well known manner. The operation of such a vending machine 10 is well known and disclosed in U.S. patent application Ser. No. 12/250,269, filed Oct. 13, 2008 and entitled Method and Apparatus for Use in a Vending Machine which is incorporated by reference herein.

Some prior art vending machines 10 include a dedicated five stick gum and roll candy shelf 12 which is designed to exclusively vend gum packages and roll candy packages having a width of approximately three inches and a height of approximately three-quarters of an inch, typically five stick gum packages and equivalent sized products. The prior art dedicated five stick gum and roll candy shelf 12 includes a support channel 13 on each side which engage sliders or shelf supports, not illustrated, located in the housing 8 to slidably support the shelf 12 in the vending machine 10. The operation of the slides or shelf supports are well known and such slides are commercially available from Vendors Exchange International Inc. in Cleveland, Ohio as Part #440278. The support channels 13 cooperate with the sliders to enable the shelf 12 to slide outwardly of the housing 8 to its position illustrated in FIG. 1 to facilitate loading of the shelf with product. The support channels 13 also enable the shelf 12 to be removed from housing 8.

Due to the shape of the old five stick gum packages and roll candy packages such as Lifesavers, the products were supported in specialized product guides 6, located on shelf 12, which were shaped and sized to fit these particular products. A pusher assembly, not illustrated, rather than a helical coil 18, was utilized to push the roll candy or five stick gum packages in a forward direction through the product guide 6 and off of the shelf 12 where the gum or candy would fall through the opening 24 into the delivery bin 20.

Vending machines of the aforesaid design include those manufactured by Automatic Products International, Ltd. formally located in St. Paul, Minn. and include Automatic Products Models AP6000, AP7000, AP112, AP113, AP122, AP123, AP132, AP133, AP932, and AP933. The operation of the prior art Automatic Products snack machines are well known and is disclosed in "Instruction Manual for Snackshop 113" by Automatic Products International, Ltd., a copy of which is attached hereto and incorporated by reference herein. In the prior art Automatic Products vending machines the product guides 6 in the dedicated roll candy and five stick gum shelf 12 measure approximately three and one-eighth inch wide by one inch in height to accommodate typical old style packaging having a size of approximately three inches by three-quarter of an inch.

Current packaging for gum and roll candy has changed from the time that the aforesaid prior art Automatic Products vending machines were designed and manufactured. The sale of roll candy and five stick gum packages have been in many instances replaced by new larger volume packages which generally have a "flat" package shape, sometimes known as slim pack, which maximizes the front display surface of the package and which provides a package which is much thinner than the front display surface of the package. Examples include packaging used by Wm. Wrigley Company and Cadbury Adams USA LLC. The newer style flat packaging does not fit in the prior art shelf 12. Accordingly, it is desirable to replace the existing gum and candy shelf 12 with a replacement shelf 30 which accommodates the new larger flat gum and candy packages and which replacement shelf 30 fits in at least some of the same slides or shelf supports located in the vending machine 10 which previously supported the prior art five stick gum and roll candy shelf 12. In addition, it is desirable to design the replacement shelf 30 to maximize the number of product guides located on the shelf 30 so as to maximize the amount and variety of product which may be stored, displayed and vended from replacement shelf 30 in the vending machine 10. It is also desirable to utilize components in the replacement shelf 30 which are similar to or common to the components utilized in shelves 14 in the vending machine 10 and to allow the new shelf 30 to easily connect to the wiring harness in the vending machine 10 to which the prior art shelf 12 was connected. For example, it is desirable to utilize similar and/or identical helical coils 18 and motor assemblies to rotate the helical coils 18.

The replacement shelf 30 more fully illustrated in FIGS. 2-6, includes a bottom planar surface 46 having a front edge 47 located adjacent to the door 15 and a plurality of parallel elongate product guides 31 located on the planar surface 46 and each of which is defined by a pair of dividers 33 which extend upwardly from the bottom planar surface 46. The dividers 33 each include a surface 35 which cooperate with the bottom planar surface 46 to define an elongate channel which defines the product guides 31. A vertical rear wall 49 extend upwardly from the rear edge of replacement shelf 30 and includes openings 55 (see FIG. 6) disposed therein each of which in part supports a motor assembly 32. A support track or channel 23 extends along each side of shelf 30 and is operable to engage the slides on which shelf 12 was supported to support the replacement shelf 30 within the vending machine.

The motor assemblies 32 are supported in the openings 55 on the rear wall 49 and include a rotatable output shaft, not illustrated, which extends through opening 55 and which is connected to a hub 54 to effect rotation of hub 54 when the motor assembly 32 is energized. A helical coil 29 having a longitudinal axis 27 is connected to the hub 54 and rotates therewith when its associated motor assembly 32 is energized to move product supported in the helical coil 29 through the product guide 31.

The motor assembly 32 (see FIGS. 2-4) includes a rectangular housing 37, a motor 50, and a reduction gear assembly (not illustrated) located in rectangular housing 37. The reduction gear assembly is connected to the motor 50 and to hub 54. The hub 54 is connected to one end of the helical coil 29 and is operable to affect rotation of the helical coil 29 about its longitudinal axis 27 when the motor 50 is energized. The motor assembly 32 which is used on the replacement shelf 30 is the same as or substantially similar to the motor assemblies used on the shelves 14 to enable the motor assemblies 32 on the replacement shelf 30 to interface to the existing wiring in the aforementioned Automatic Product vending machines. The prior art motor assemblies 32 including the motor 50 and reduction gear assemblies are available from Vendors Exchange International Inc in Cleveland, Ohio as part VE2995 or VE8318 and are packaged in a generally rectangular shaped housing 37 approximately two and one-half inches by three and one-half inches by five-eighth inch. The motor assembly 32 is more fully disclosed in U.S. Pat. No. 5,446,326 which is incorporated by reference herein. The use of similar motor assemblies 32 on the shelves 14 and on the replacement shelf 30 enables the motor assemblies 32 on the replacement shelf 36 to easily connect to the preexisting wiring harnesses located within the aforementioned Automatic Products vending machine and to which the prior art five stick gym and roll candy shelf 12 was previously connected.

Figure 5:
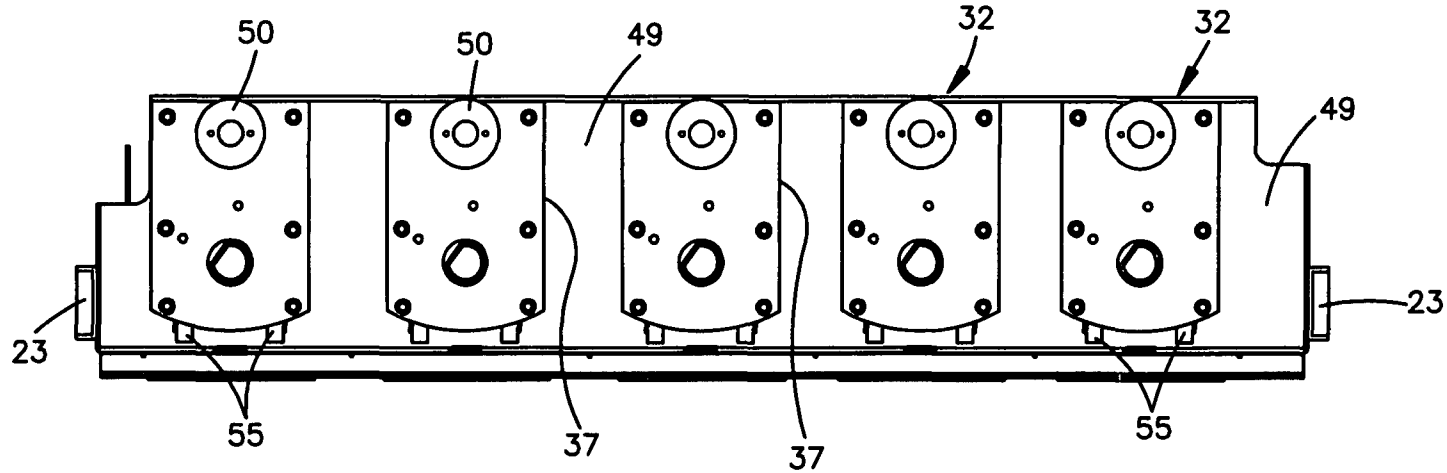
FIG. 5 is a rear view of the replacement shelf taken approximately along the lines 5-5 of FIG. 2.

To maximize the number of product guides 31 located in the replacement shelf 30, the motor assembly 32 is mounted in a vertical orientation, i.e., the longest portion of the housing 37 (three and one-half inches) is disposed vertically as is illustrated in FIG. 5 to minimize the width (two and one-half inches) of the motor assembly 32 on the rear wall 49 of the shelf 30 (see FIG. 5). This maximizes the number of motor assemblies 32 which can be fit on the rear wall 49 of the shelf 30. Maximizing the number of motor assemblies 32, maximizes the number of product guides 31 and the number and variety of products which can be displayed, stored and vended from the product guides 31. When the motors assemblies 32 are mounted vertically, as is illustrated in FIG. 5, it has been found that five parallel product guides 31 can be located on a replacement shelf 30 for the Automatic Products Snack Machines Models AP6000, AP7000, AP112, AP113, AP122, AP123, AP132, AP133, AP932, and AP933 and the replacement shelf 30 can be located in the prior art Automatic Products vending machines utilizing at least some of the same slides on which the prior art five stick gum and roll candy shelf 12 was originally supported. In addition, the motor assemblies 32 are adapted to connect to the same wiring in the Automatic Products vending machines to which the original five stick gum and roll candy shelf 12 was connected.

The output of the motor assembly 32 is connected to a hub 54 which is attached to the end 56 of the helical coil 29. The helical coil 29 includes a portion which is disposed adjacent to the bottom surface 46 of the product guide which in part supports helical coil 29. Rotation of the hub 54 by the motor assembly 32 affects rotation of the helical coil 29 about its longitudinal axis 27 in a well known manner.

Some of the Automatic Products snack machine models AP6000, AP7000, AP112, AP113, AP122, AP123, AP132, AP133, AP932, and AP933 include a spacer 40 on which the slides which support one side of the shelf 12 are located. The slides located on the spacer 40, not illustrated, engages the support channel 13 on one side of the five stick gum and roll candy (the left side as viewed in FIG. 1). Additional slides, not illustrated, engage with the support channel 13 located on the opposite side of shelf 12 (the right side as viewed in FIG. 1). If desired, the spacer 40 can be removed from some of the prior art Automatic Products vending machines and the slides mounted thereon can be moved and mounted on the inside of the housing 8 to thereby accommodating a replacement shelf 30 which is wider than original shelf 12 and which may include more than five product guides 31. It has been found that if the spacer 40 is removed and the slides are moved to the side wall of the housing 8, as many as seven parallel product guides 31 can be accommodated on the replacement shelf 30 in some of the Automatic Products machines. In some Automatic Product snack machines, the left hand slide, when viewed from the front of the machine, must be relocated and/or replaced to accommodate the new replacement shelf 30.

The replacement shelf 30, as is more fully illustrated in FIGS. 2-6 is adapted to be supported on support tracks 23 within the cabinet 8 of the vending machine 10 on the at least some of the same slides which supported the original five stick gum and roll candy shelf 12. Support tracks 23 engage the slides and allow shelf 30 to slide outwardly from the cabinet 8 to facilitate loading of the shelf 30 with products. The space between the replacement shelf 30 and the shelf 14 which is disposed immediately above the replacement shelf 30 is limited in the Automatic Products Model AP6000, AP7000, AP112, AP113, AP122, AP123, AP132, AP133, AP932, and AP933 snack machines. The five stick gum and roll candy shelf 12 which is to be replaced has a smaller height than the shelves 14 in the Automatic Product snack machines. The product to be accommodated in the prior art five stick gum and roll candy shelf 12 was rather small product, generally less than an inch in height, as compared to the remainder of the snacks to be vended in the shelves 14. Accordingly, the height of the shelf 12 and the vertical space provided in the Automatic Products machines for shelf 12 is less than that provided for the shelves 14. The new replacement shelf 30 which includes motor assemblies 32 and helical coils 29 requires more vertical spacing in the vending machine 10 than the prior art five stick gum and roll candy shelf 12 which it replaces. This necessitates that the bottom planar surface 46 of the replacement shelf 30 is located vertically below where the bottom of the five stick gum and roll candy shelf 12 was originally located. This can present problems when product is moved from one of the product guides 31 on the replacement shelf 30 through the opening 24 in the top of the delivery bin 20 located on the door 15 of the vending machine 10.

The door 15 supports the delivery bin 20 thereon and when the door 15 is closed, the opening 24 in the top of the delivery bin 20 is located beneath the front edge 3 of each of the product shelves 14 and is adapted to receive product which is selected to be vended, which selected product falls from one of the shelves 14, through the opening 24 and into the delivery bin 20 when its associated helical coil 18 is rotated.

Figure 4:
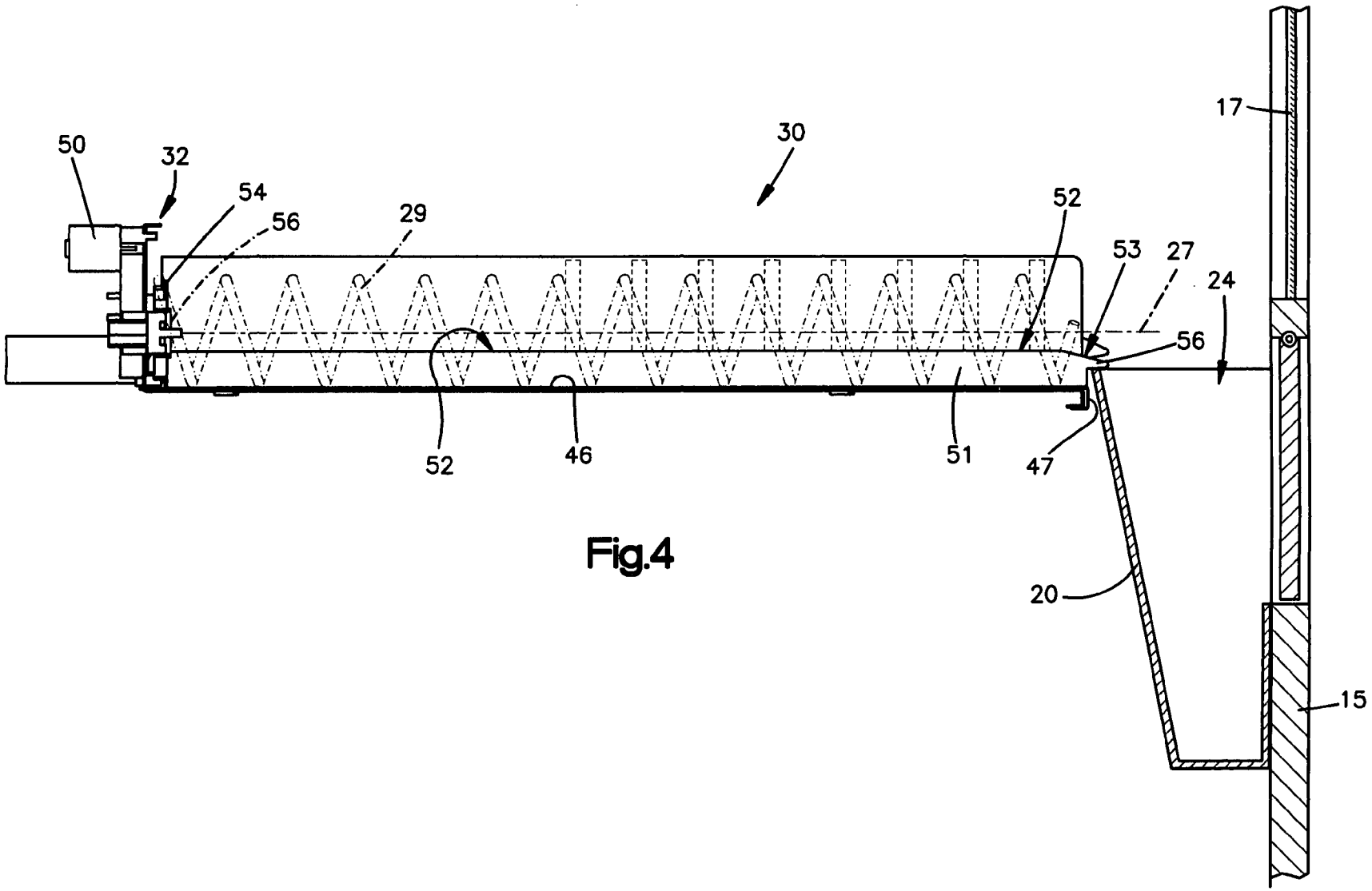
FIG. 4 is a side view of the replacement shelf taken approximately along the lines 4-4 of FIG. 2 and more fully illustrating the cooperation between the delivery bin mounted on the door and the replacement shelf.

It has been found that in many of the older Automatic Product snack machines the hinged door 15 sags slightly on the hinges 7 which support the door 15. Sagging of the door 15 relative to the cabinet 8 slightly moves the position of the delivery bin 20 and the opening 24 at the top thereof when the door 15 is closed. The sagging of the door 15 sometimes causes the delivery bin 20 to not be perfectly aligned within the front edge 47 of the replacement shelf 30. The sagging of the door 15 along with the increased height of the replacement shelf 30 as compared to the original shelf 12 necessitate that the bottom planar surface 46 of the replacement shelf 30 sometimes is disposed vertically below the opening 24 in the top of the delivery bin 20 as is illustrated in FIG. 4. Additionally, since replacement self 30 engages with the delivery bin 20 when door 15 is closed (see FIG. 4) the replacement shelf 30 is slightly shorter than shelves 14.

A pair of spaced apart elongate product rails 51 which form a product support is located within each of the product guides 31 on the replacement shelf 30. Each of the product rails 51 includes a product support surface 52 at the top thereof for supporting new style "flat" packaged gum and candy products which are stored, displayed and vended from the product guides 31. The product support surface 52 is adapted to support the products to be vended within the helical coil 29 in a position above the bottom planar surface 46 of the replacement shelf 30 and vertically above the opening 24 in the top of the delivery bin 20 when door 15 is closed. Each elongate product support rail 51 includes a portion 56 which extends beyond the front edge 47 of the bottom planar surface 46 of the replacement shelf 30 and which includes a product support surface 53 which extends horizontally beyond the front edge 47 of the planar bottom surface 46 of the product guide 31 and which is located, when door 15 is closed, directly above the opening 24 in the delivery bin 20. Rotation of the helical coil 29 by motor assembly 32 moves product along the product support 52 surface, over product support surface 53 and into the opening 24 at the top of the delivery bin 20. It is noted that the product support surface 53 is inclined in a downward fashion from the product support surface 52. When product is moved along the product support surface 52 upon rotation of the helical coil 29, product slides to the product support surface 53 and slides downwardly on the surface 53 under the influence of gravity into the opening 24 on the top of the delivery bin 20.

Figure 2:
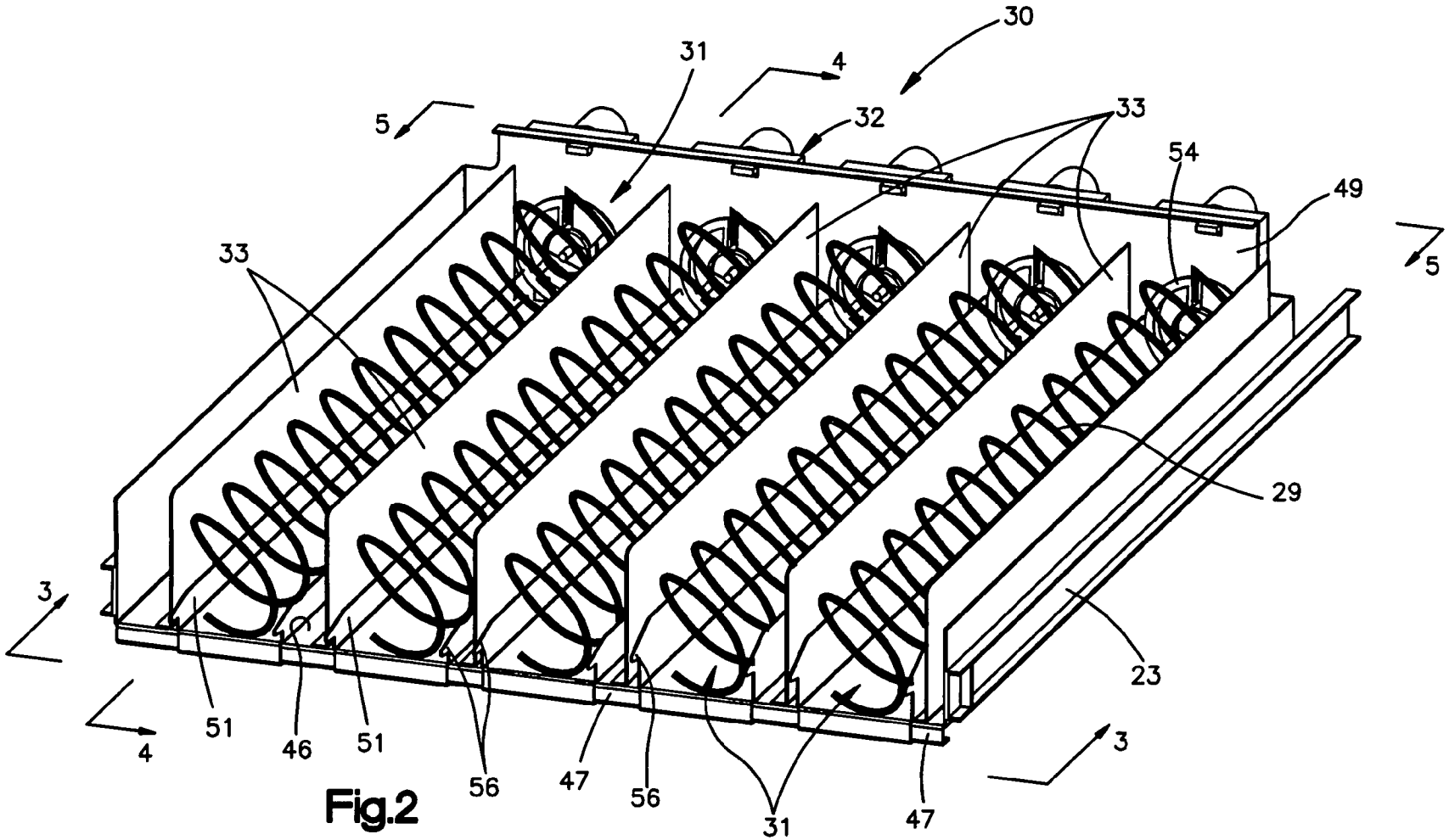
FIG. 2 is a perspective view of a new replacement shelf for replacing the five stick gum and roll candy shelf in the prior art vending machine of FIG. 1.
Figure 3:
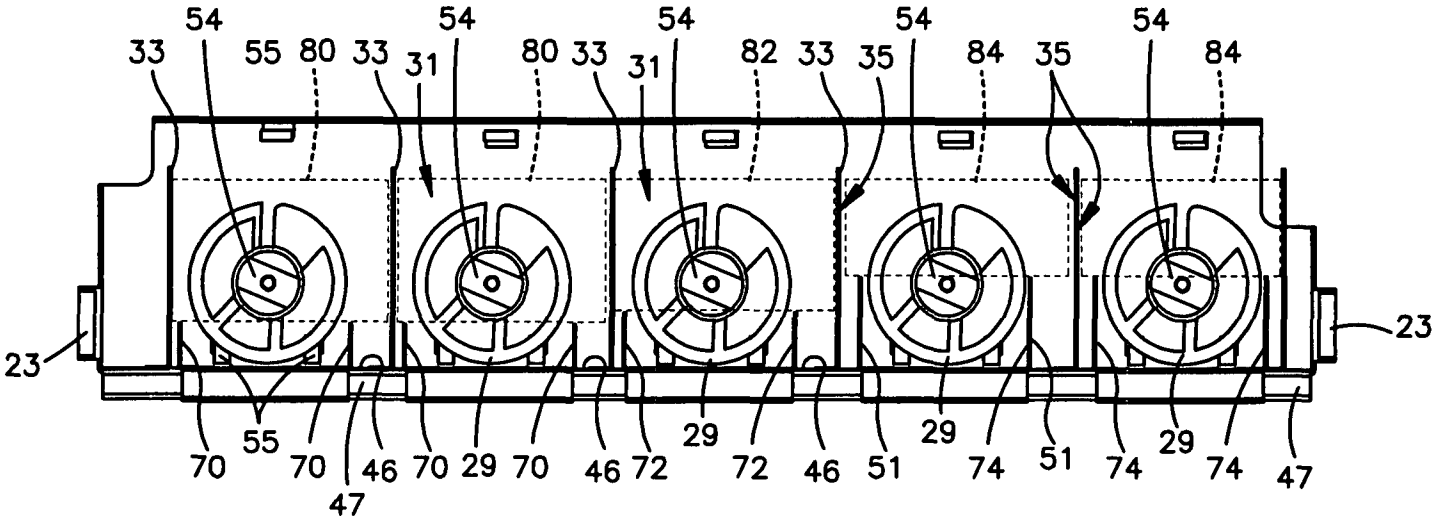
FIG. 3 is a front view of the replacement shelf taken approximately along the lines 3-3 of FIG. 2.

As is disclosed in FIGS. 2 and 3, each product guide 31 includes a pair of product rails 51 which are spaced apart and located on either side of the helical coil 29. The top surface 52 of the product rails 51 cooperate with the helical coils of the coil 29 to support product to be vended within the product guide 31. The product support surfaces 52 engages with the bottom surface of product supported in the product guide 31 and the coils 29 engage with the front and/or back surfaces of the product and cooperate with the side surfaces 35 of the dividers 33 to support the product in a position in which the front of the product is readily viewable through the window 17 located in the door 15 of the vending machine 10.

The height of the product rails 51 and product support surfaces 52 can be varied to accommodate product of different heights. It is noted in FIGS. 2 and 6 that three different height product rails 51 are disposed in the product guides, i.e., product rails 70, 72 and 74. The product rails 70, 72 and 74 vary in height with rails 70 being the shortest and rails 74 being the tallest, as measured vertically from the bottom planar surface 46 of the replacement shelf 30. This enables various size products to be accommodated within the product guide 31 while being substantially horizontally aligned as viewed through the window 17. This is further illustrated in FIG. 3 wherein a product such as Dentyne 12 piece sugarless gum having a height of approximately two and a quarter inches is illustrated in phantom lines 80 supported on product rails 70, a product such as Orbit 14 piece sugarfree gum having a height of approximately one and seven eighth inches is illustrated in phantom lines 82 supported on product rails 72, and a product such as Trident 18 stick gum having a height of approximately one and one-quarter inches is illustrated in phantom lines 84 supported on product rails 74. In one embodiment of the invention product rail 70 has a height of approximately one and one-eighth inches, product rail 72 has a height of approximately one and three eighth inches and product rail 74 has a height of approximately two inches.

The different height product rails 70, 72 and 74 allow different height product (Dentyne, Orbit and Trident) to have their top edges substantially aligned horizontally across the front of the shelf 30 as is illustrated in phantom lines in FIG. 3. It should be appreciated that the height of the product rails 51 and the horizontal spacing of the product rails 51 within the product guides 31 can be varied to accommodate various sized products. Use of different height product rails 70, 72 and 74 enables different height product to be uniformly displayed within the product guides 31 on the replacement shelf 30. Additionally, the horizontal spacing of dividers 33 can be varied to also facilitate the accommodation of different size product within the product guides 31.

Figure 9:
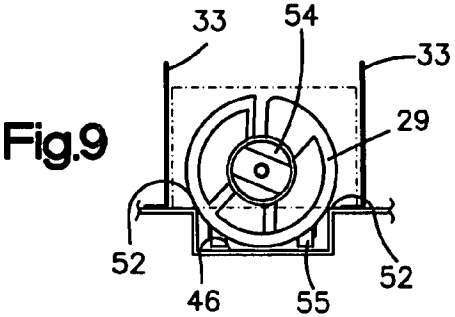
FIG. 9 is a front view of another embodiment of the replacement shelf.
Figure 6:
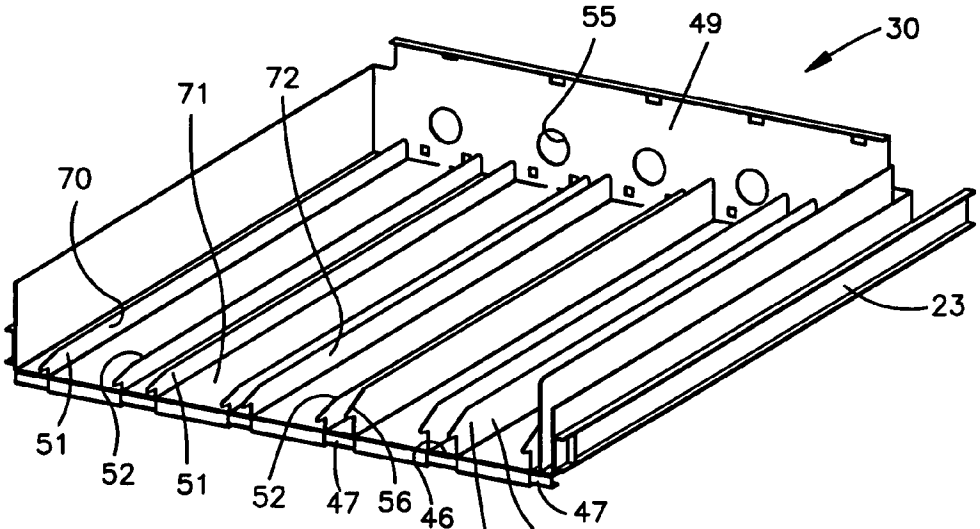
FIG. 6 is a perspective view of the replacement shelf, similar to FIG. 2, with the motors, helical coils and dividers removed to more fully illustrate the elongate product supports and the product support surfaces.

The two product rails 51 within each of the product guide 31 are formed as an integral U-shaped assembly and each rail 51 is an upwardly extending arm of the U-shaped assembly and a bottom surface 71 extends therebetween. The U-shaped assembly is connected to the bottom planar surface 46 and the front edge 47 of the shelf 30. While a U-shaped assembly is disclosed, it is within the scope of the present invention to make each product rails 51 a separate piece and to mount each rail 51 separately within the product guides 31. Alternatively, it is possible to mold or stamp the bottom surface 46 of the replacement shelf 30 to form product support surfaces 52 integrally on the shelf 30 as is illustrated in FIG. 9 rather than utilize a separate product support rail 51. While the support rails 51 are disclosed as being generally rectangular in shape and the product support surface 52 is substantially parallel to the planar bottom surfaces 46 it is within the scope of the present invention to shape the product support rail 51 so that product support surface 52 is inclined relative to the planar bottom surface 46.

Figure 8:
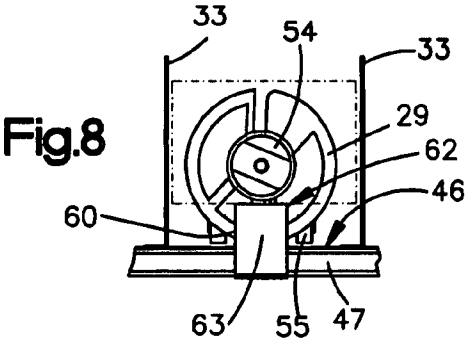
FIG. 8 is a front view of the product guide of FIG. 7 taken approximately along the lines 8-8 of FIG. 7.
Figure 7:
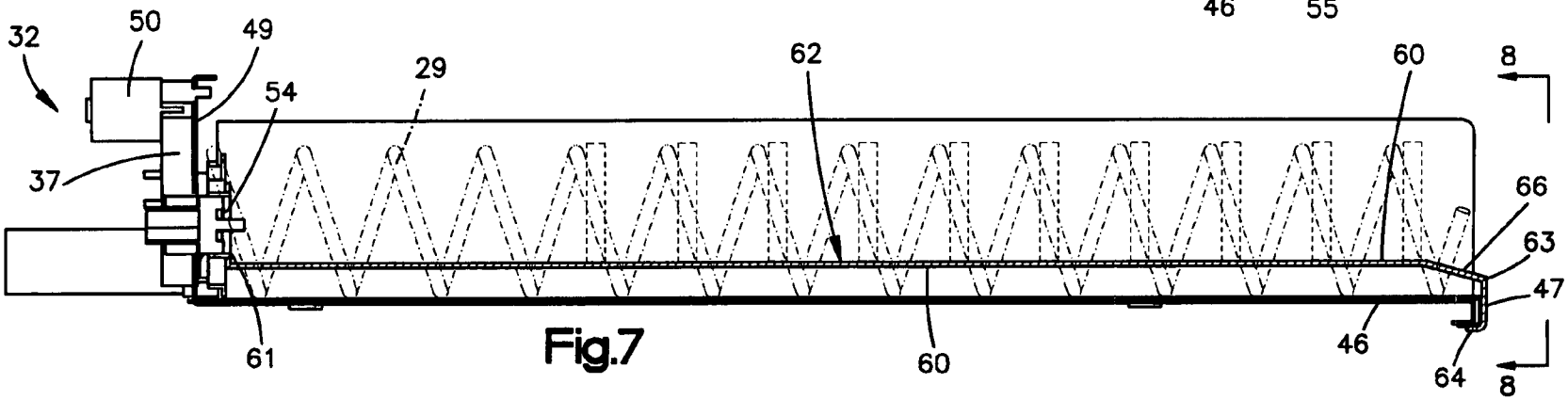
FIG. 7 is a side view of another embodiment of the elongate product support for supporting products to be vended in a position above the planar bottom surface of the product guide.

FIGS. 7 and 8 discloses another embodiment of the invention which is similar to the embodiments disclosed in FIGS. 2-6 (like numbers are used to designate identical parts) with the exception that product support 60 is utilized in each product guide 31 rather than a pair of product support rails 51. The product support 60 includes a support surface 62 which centrally supports products thereon within helical coil 29 in a position above the planar bottom surface 46 of the replacement shelf 30. The product support 60 is non-rotatably supported at one end 61 in part by the hub 54 and extends centrally through the coils of the helical coil 29 as is more fully disclosed in FIGS. 7 and 8. The opposite end 63 of the product support 60 can be affixed at 64 to the front edge 47 of the planar bottom surface 46 of the replacement shelf 30. The product support 60 includes the support surface 62 and the downwardly inclined portion, support surface 66, which extends beyond the front edge 47 of the bottom planar surface 46 of the replacement shelf 30 to a position located above the opening 24 in the delivery bin 20 when door 15 is closed to ensure that product passing from the product support surfaces 62 and 66 falls through opening 24 into the delivery bin 20.

From the foregoing, it should be apparent that a new and improved replacement shelf 30 has been provided to replace an existing five stick gum and mint shelf 12 in an Automatic Products vending machine 10. The new shelf 30 is adapted to store, display, and vend new "flat" gum and candy packages and fits in the same support slides as the five stick gum and candy shelf 12 when the five stick gum and candy shelf 12 is removed. The new replacement shelf includes product support surfaces 52, 62 which raises product above the bottom planar surface 46 of the replacement shelf 30 to ensure product to be vended falls through an opening 24 at the top of the delivery bin 20 where the product can be retrieved by a purchaser.

The invention claimed is:

1. A shelf for storing and vending products, said shelf comprising a bottom having a front portion adapted to be located adjacent to a front portion of a vending machine and a rear portion adapted to be located adjacent to a rear wall of the vending machine, and a plurality of product receiving locations disposed on said shelf, each of said product receiving locations includes a helical coil which extends between the front and rear portions of said bottom, said helical coil being rotatable about its longitudinal central axis to move products engaged by said helical coil away from the rear portion of said bottom toward the front portion of said bottom, a first product support rail extending along and spaced apart from a first side of said helical coil, said first product support rail extending along said helical coil for a distance which is at least as great as the length of said helical coil to enable said first product support rail to engage lower portions of products throughout movement of products engaged by said helical coil away from the rear portion of said bottom toward the front portion of said bottom, and a second product support rail extending along and spaced apart from a second side of said helical coil, said second product support rail extending along said helical coil for a distance which is at least as great as the length of said helical coil to enable said second product support rail to engage lower portions of products throughout movement of products engaged by said helical coil away from the rear portion of said bottom toward the front portion of said bottom, said first and second product support rails being spaced apart by a distance which is greater than an outside diameter of said helical coil, said first and second product support rails being effective to support products with the products disposed above and spaced apart from said bottom throughout movement of products engaged by said helical coil away from the rear portion of said bottom toward the front portion of said bottom, said first product support rail has a lower edge portion which is connected with said bottom and extends parallel to a longitudinal central axis of said helical coil, an upper edge portion which is disposed above said lower edge portion and extends parallel to the longitudinal central axis of said helical coil, and major side surfaces which extend between said upper and lower edge portions of said first product support rail and extend transverse to said bottom, said second product support rail has a lower edge portion which is connected with said bottom and extends parallel to the longitudinal central axis of said helical coil, an upper edge portion which is disposed above said lower edge portion and extends parallel to the longitudinal central axis of said coil, and major side surfaces which extend between said upper and lower edge portions of said second product support rail and extend transverse to said bottom, said upper edge portions said first and second product rails being spaced apart by a distance which is greater than an outside diameter of said helical coil, said first product support rail includes a front end portion which extends beyond the front portion of said bottom said front end portion of said first product support rail is angled downwardly toward a delivery bin in the front portion of the vending machine to promote downward movement of products from the first product support rail toward the delivery bin, said second product support rail includes a front end portion which extends beyond the front portion of said bottom, said front end portion of said second product support rail is angled downwardly toward the delivery bin to promote downward movement of products from the second product support rail toward the delivery bin.

2. A shelf as set forth in claim 1 wherein said major side surfaces of said first and second product support rails extend perpendicular to said bottom.

3. A shelf as set forth in claim 1 wherein said upper edge portions of said first and second product support rails are disposed further from said bottom than the longitudinal central axis of said helical coil to enable said upper edge portions of said first and second product support rails to support products with lower portions of the products disposed above the longitudinal central axis of said helical coil.

4. A shelf as set forth in claim 1 wherein a portion of said helical coil is disposed below an upper portion of the delivery bin and said front end portions of said first and second product rails are disposed in engagement with the upper portion of the delivery bin.

* * * * *